US007490574B2

(12) United States Patent
Shearer et al.

(10) Patent No.: US 7,490,574 B2
(45) **Date of Patent: *Feb. 17, 2009**

(54) CONVERTIBLE BOAT TOP

(75) Inventors: Robert R. Shearer, Ellenton, FL (US); Kevin Stancil, Bradenton, FL (US)

(73) Assignee: Taylor Made Group, Inc., Gloversville, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/640,993

(22) Filed: Dec. 19, 2006

(65) Prior Publication Data

US 2007/0095272 A1 May 3, 2007

Related U.S. Application Data

(63) Continuation of application No. 10/640,579, filed on Aug. 14, 2003, now Pat. No. 7,159,530.

(60) Provisional application No. 60/402,945, filed on Aug. 14, 2002.

(51) Int. Cl.
*B63B 17/02* (2006.01)
*E04H 15/06* (2006.01)

(52) U.S. Cl. ..... 114/361; 114/343; 135/88.01

(58) Field of Classification Search ..... 114/361, 114/364, 343; 296/100.11, 100.14, 100.16, 296/100.18, 107.01, 108; 135/88.01, 88.03, 135/88.05, 88.1, 88.11, 121–126
See application file for complete search history.

(56) References Cited

U.S. PATENT DOCUMENTS

| | | | | |
|---|---|---|---|---|
| 2,833,296 | A * | 5/1958 | Woodruff, Sr. | 114/361 |
| 2,937,652 | A | 5/1960 | Zimmer, Jr. et al. | |
| 3,018,784 | A | 1/1962 | Buxman | |
| 3,172,419 | A * | 3/1965 | Lewis | 114/361 |
| 3,285,259 | A | 11/1966 | Hale | |
| 3,367,349 | A | 2/1968 | O'Link | |
| 3,371,672 | A | 3/1968 | Hale et al. | |
| 3,823,431 | A | 7/1974 | Miller | |
| 4,091,484 | A * | 5/1978 | Means | 114/361 |
| 5,005,896 | A | 4/1991 | Li | |
| 5,238,288 | A | 8/1993 | Chandler | |
| 5,303,667 | A * | 4/1994 | Zirkelbach et al. | 114/361 |
| 5,664,519 | A * | 9/1997 | Erskine | 114/361 |
| 5,931,114 | A * | 8/1999 | Bartholomew | 114/361 |
| 6,595,155 | B1 | 7/2003 | Akers | |

FOREIGN PATENT DOCUMENTS

| | | |
|---|---|---|
| DE | 198 23 377 | 1/2000 |
| FR | 2 753 166 | 3/1998 |
| FR | 2 753 167 | 3/1998 |
| FR | 2753167 A1 * | 3/1998 |
| GB | 7470 | 0/1913 |
| WO | WO 90/08058 | 7/1990 |
| WO | WO 94/27863 | 12/1994 |

* cited by examiner

*Primary Examiner*—Ajay Vasudeva
(74) *Attorney, Agent, or Firm*—Nixon & Vanderhye P.C.

(57) ABSTRACT

A convertible boat top provides a covered area to protect the occupants from environmental concerns such as sun, rain, etc. The convertible top is easily deployed and can be unobtrusively tucked away into a storage area. The top can be provided as original equipment or may be embodied as a kit to adapt an existing boat.

17 Claims, 7 Drawing Sheets

CONVERTIBLE BOAT TOP

CROSS-REFERENCES TO RELATED APPLICATIONS

This application is a continuation of U.S. patent application Ser. No. 10/640,579, filed Aug. 14, 2003 now U.S. Pat. No. 7,159,530, which claims the benefit of U.S. Provisional Patent Application Ser. No. 60/402,945, filed Aug. 14, 2002, the entire contents of which are hereby incorporated by reference in this application.

BACKGROUND OF THE INVENTION

The present invention relates to a convertible top for a boat or the like and, more particularly, to a convertible boat top that is easily deployed and retracted and can be unobtrusively tucked away into a storage area.

Many boat models typically do not include a covered area that is easily deployed to protect the occupants from environmental concerns, such as sun, rain, etc. It would be desirable to provide a convertible top attachment that could be readily adapted for an existing boat. At the same time, however, the convertible boat top should be easily extended and retracted into and out of the use position. Still further, in a retracted position, the components of the top should be unobtrusively stored away.

SUMMARY OF THE INVENTION

In an exemplary embodiment of the invention, a convertible boat top includes a canopy and a support structure supporting the canopy and shiftable with the canopy between a stowed position and an installed position. The support structure includes a main support bar engaging the canopy and coupled with a sliding mechanism. The main support bar is disposed in a first position in the sliding mechanism when the support structure is in the stowed position and in a second position in the sliding mechanism when the support structure is in the installed position.

Preferably, the support structure additionally includes a pair of interim brackets respectively pivotally attached at one end to the main support bar and attached at an opposite end to the canopy. In this context, the interim brackets may be attached to the canopy via respective canopy brackets. A secondary support bar may be pivotally secured to the main support bar and include a crossbar extending across a width of the main support bar, which secondary support bar supports a middle portion of the canopy. In a preferred arrangement, the canopy includes a first sleeve through which the main support bar is threaded and a second sleeve through which the secondary support bar is threaded. In this context, the first sleeve is disposed at a rearward end of the canopy, and the second sleeve is disposed at the middle portion of the canopy. The canopy may include a relief zipper extending from an area of the canopy adjacent at least one of the interim brackets.

In one arrangement, the canopy includes a canopy trim defining a shaped rigid forward perimeter of the canopy. The canopy trim preferably comprises a rigid or semi-rigid rod threaded into a pocket formed in the forward perimeter of the canopy. The canopy trim may be bowed such that the canopy does not sit flush with a top trim of a boat windshield frame. One or more attachment clips may be secured to the canopy via the canopy trim, wherein each attachment clip is selectively securable to a top trim of a boat windshield frame.

With the canopy trim defining a shaped rigid forward perimeter of the canopy, the support structure may further include a pair of interim brackets respectively pivotally attached at one end to the main support bar and attached at respective opposite ends to ends of the canopy trim. In this context, the interim brackets and the canopy trim are preferably pivotable to a position adjacent the main support bar in the stowed position. In a similar construction, the secondary support bar may also be included such that the interim brackets, the canopy trim and the secondary support bar are pivotable to a position adjacent the main support bar in the stowed position.

The sliding mechanism preferably includes a slide rail attachable to an interior boat surface and a sliding bracket mounted in sliding engagement with the slide rail. In this context, the main support bar may be pivotably secured to a first end of the sliding bracket, and the sliding mechanism may further include a pivot device pivotably secured between a second end of the sliding bracket and the main support bar. The pivot device is preferably configured to bias the main support bar toward the installed position.

In another exemplary embodiment of the invention, a boat windshield assembly utilizes the convertible boat top of the invention. In a similar context, in still another exemplary embodiment of the invention, a boat incorporates the convertible boat top of the invention. In yet another exemplary embodiment of the invention, the convertible boat top is embodied in a kit for assembling the convertible boat top.

In a further exemplary embodiment of the invention, a convertible boat top includes a canopy including a canopy trim defining a shaped rigid forward perimeter of the canopy; and a support structure supporting the canopy, the support structure including a main support bar supporting a rearward perimeter of the canopy, and a pair of interim brackets respectively pivotally attached at one end to the main support bar and attached at an opposite end to the canopy trim supporting the forward perimeter of the canopy. The interim brackets and the canopy trim are pivotable to a position adjacent the main support bar in a stowed position.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
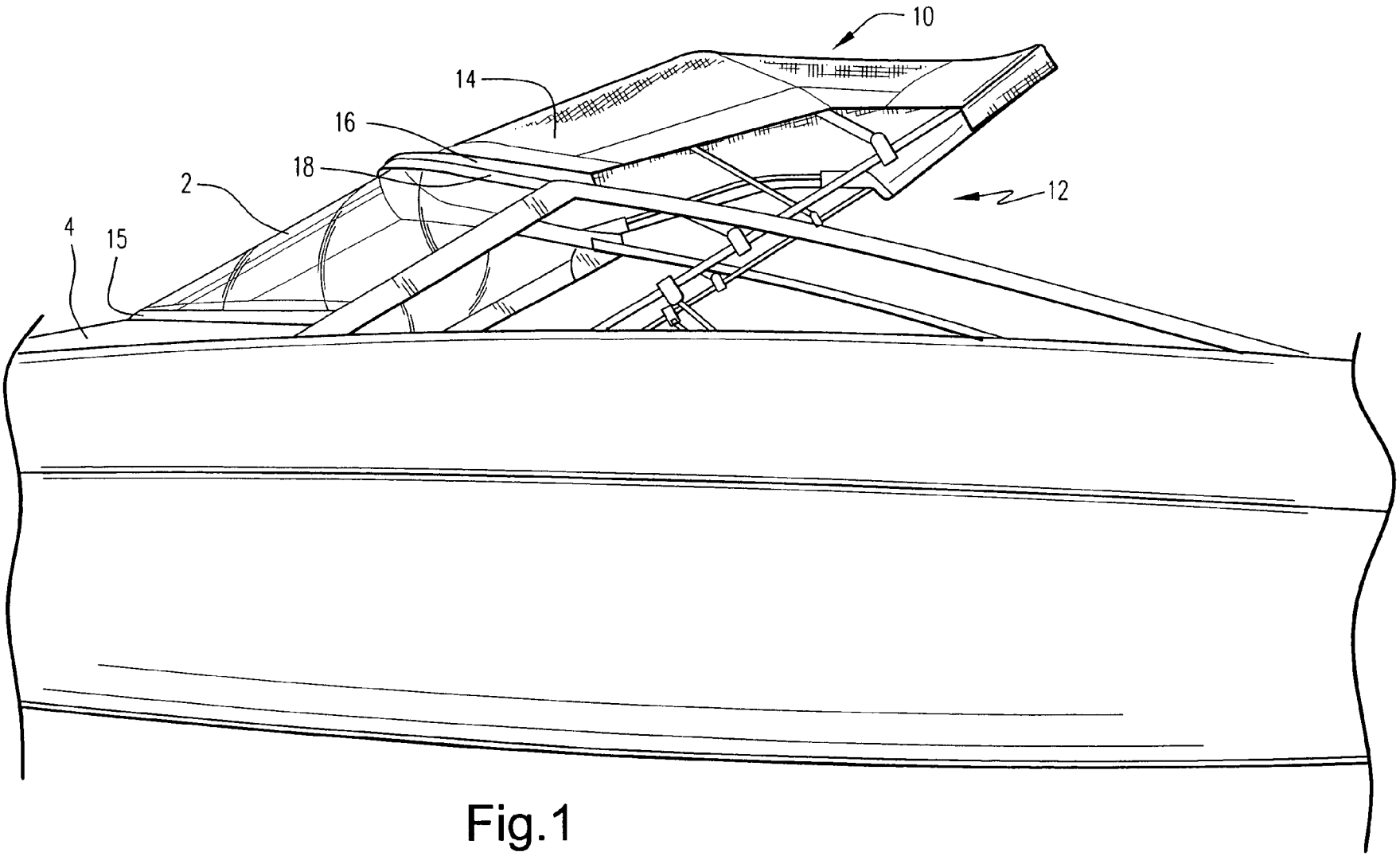
FIG. 1 shows a boat with the convertible boat top according to the present invention in its extended position.

With reference to FIG. 1, the convertible boat top 10 according to the present invention is shown installed in a conventional open-top boat including a windshield 2 supported by a bottom trim member 15 secured to a boat frame 4. Preferably, the convertible boat top 10 of the invention includes support structure 12 supporting a fabric canopy 14.

At a front end, the canopy 14 is provided with a trim member 16 securing connectors that attach to a top trim 18 of the boat windshield frame.

Figure 2:
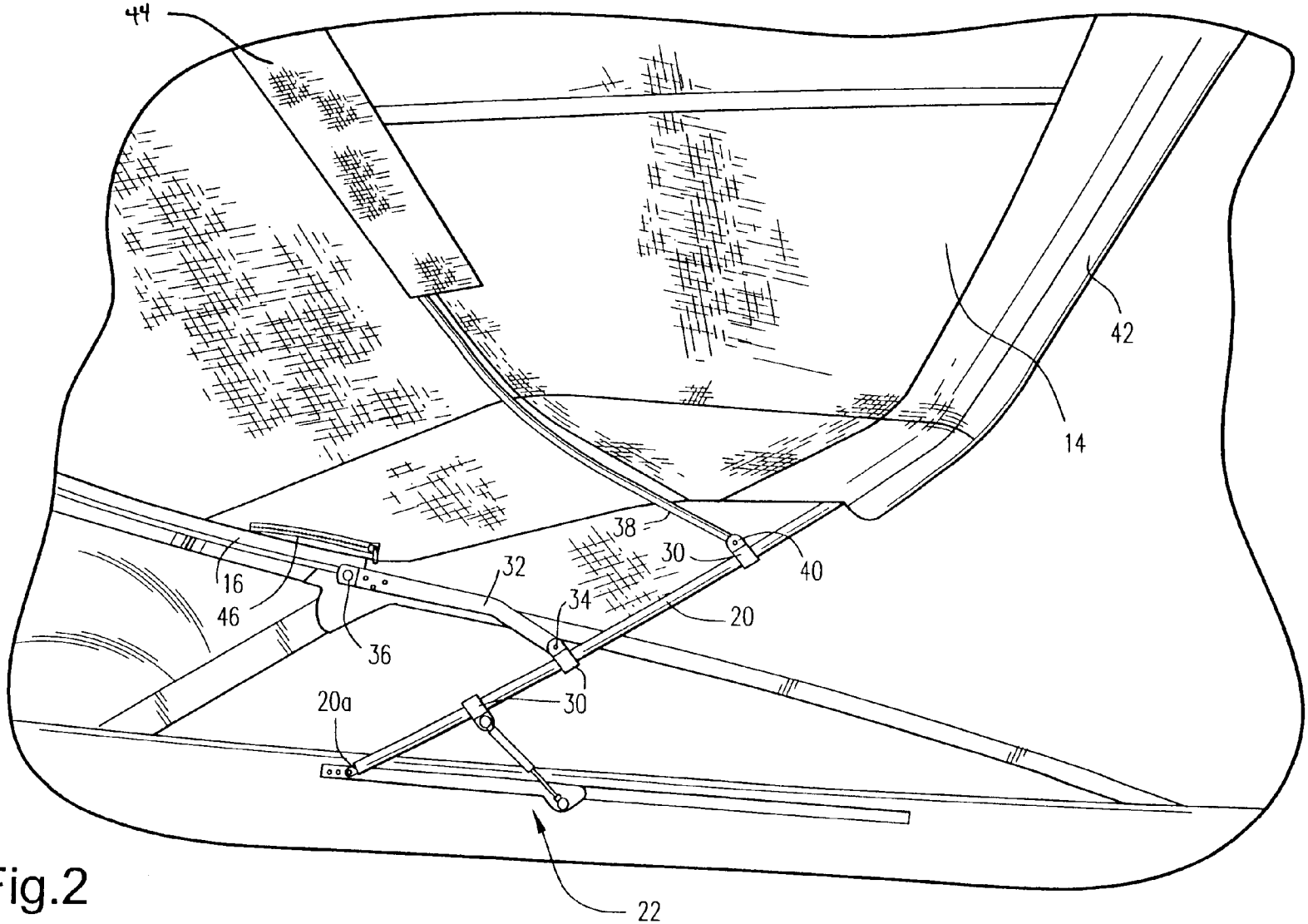
FIG. 2 is a closer view of the attachment structure for the convertible boat top.
Figure 3:
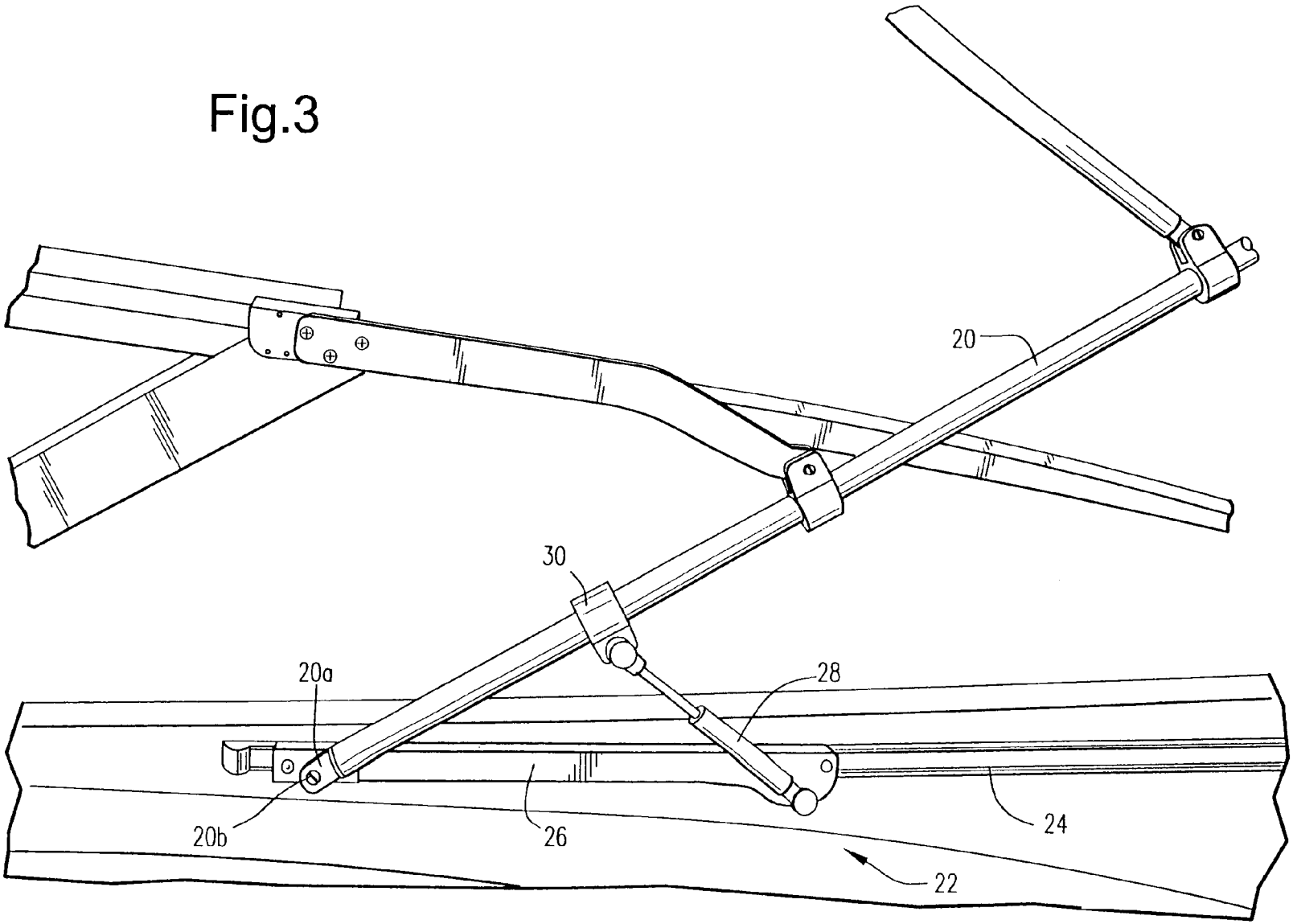
FIG. 3 is a closer view of the sliding and link mechanisms.

FIGS. 2 and 3 show details of the support structure 12. A main support bar 20 is generally U-shaped including a cross rail extending substantially the width of the boat and two support rails bent relative to the cross rail. In FIG. 2, only one side of the main support bar 20 is shown, it being understood that the other side is essentially identical in construction.

An end 20*a* of the support bar 20 is pivotally secured to a slide mechanism 22. With reference to FIG. 3, the slide mechanism 22 includes a slide rail 24 secured to an interior surface of the boat via any suitable means and a slide bracket 26. The slide bracket 26 is mounted in sliding engagement on the slide rail 24 for sliding between a forward position (shown in FIG. 3) and a rearward position. The end 20*a* is pivotally secured to a forward end of the slide bracket 26 via a pivot 20*b*. This attachment can be effected by any suitable means. A piston device such as a piston member or gas strut 28 is pivotally secured at one end to a rearward end of the slide bracket 26. Although a gas strut is preferred, the pivot device may also comprise a suitably configured spring, hydraulic or pneumatic cylinder, electric actuator or the like. An opposite end of the gas strut 28 is pivotally secured via a connector 30 to the main support bar 20. Preferably, the connector 30 is fixed to the main support bar 20 at a position spaced from the end 20*a* of the main support bar 20 to enable the gas strut 28 to have appropriate leverage for assisting the main support bar 20 and attached canopy. In operation, the gas strut 28 is displaceable between an extended position (as shown in FIG. 3) and a retracted position, corresponding to the installed position of the boat top and a stowed position of the boat top, respectively.

Figure 7:
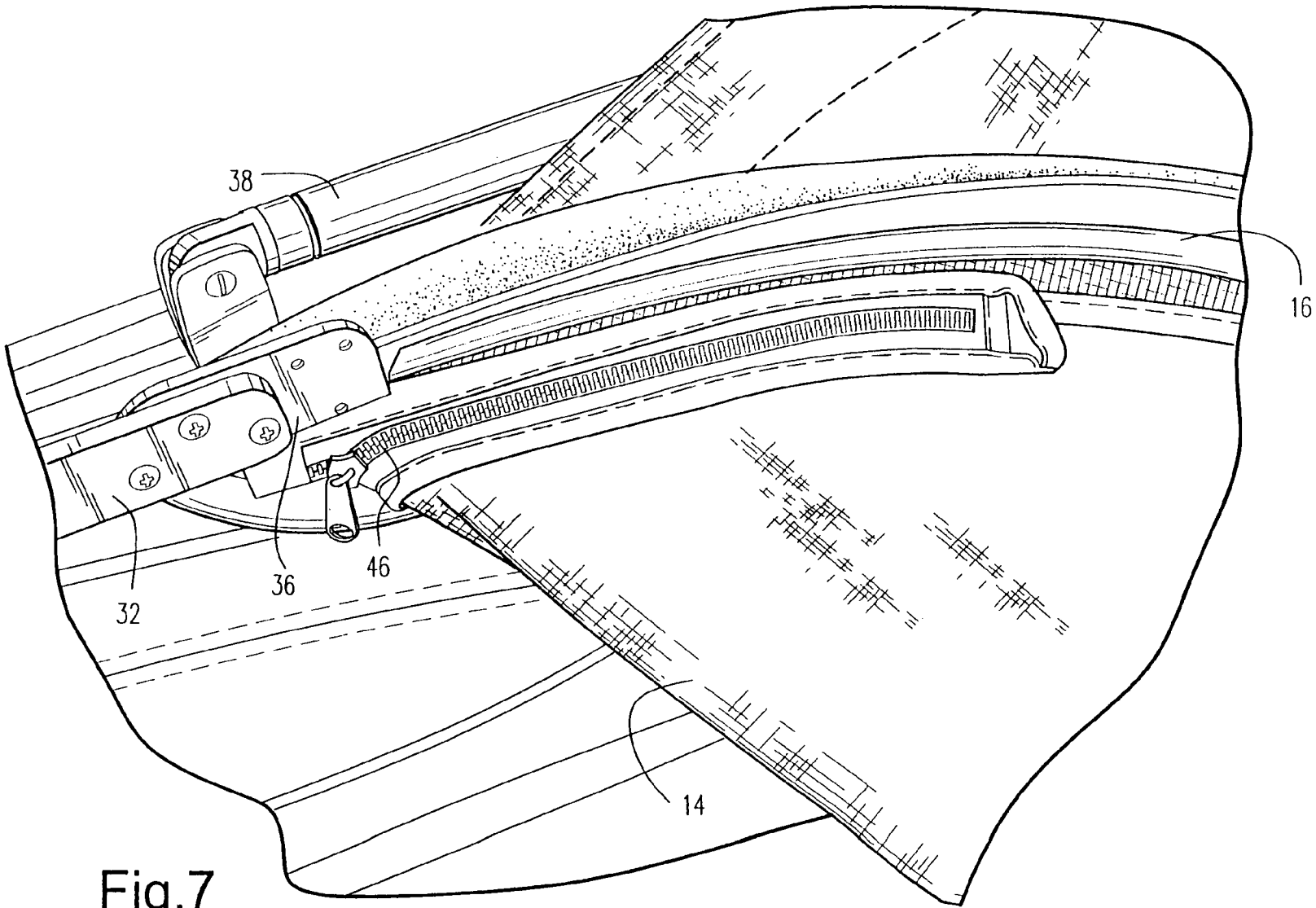
FIG. 7 shows a relief zipper of the convertible top to facilitate storage.

With continued reference to FIG. 2 and with reference to FIG. 7, an interim bracket 32 is pivotally attached to the main support bar 20 via a connector 30 for pivoting about a pivot point 34. An opposite end of the interim bracket 32 may be fixed, via screws or the like to a bracket 36 mounting the canopy trim 16 or may be mounted directly to the canopy trim 16.

A secondary support bar 38 also in a substantially U-shape configuration and including a crossbar extending across the width of the boat is pivotally secured to the main support bar 20 via another connector 30 for pivoting about pivot point 40. The secondary support bar 38 supports a middle portion of the canopy 14 as shown in, for example, FIG. 2.

The canopy 14 is generally made of a fabric material although other materials may be suitable for the convertible boat top according to the present invention. The canopy 14 includes a first sleeve 42 at a rearward end of the canopy 14 preferably sewn therein in which is received the main support bar 20 as shown in FIG. 2. A second sleeve 44 located at an intermediate portion of the canopy 14 receives the secondary support bar 38 as also shown in FIG. 2. The sleeves 42, 44 may also be secured in any other suitable manner, such as welded, zipped, or the like. The forward end of the canopy includes the canopy trim 16, which is formed of a rigid or semi-rigid rod-like material such as extruded aluminum, defining a shaped rigid forward perimeter of the canopy 14. The canopy trim 16 is preferably threaded into a pocket formed in the forward perimeter of the canopy 14, although other suitable means for securing the canopy trim 16 may of course be contemplated. The canopy trim 16 is mounted at either end. Any suitable connecting structure can be used. Preferably, the canopy trim 16 is slightly bowed so that the canopy does not sit flush with the top trim of the windshield frame without a positive coupling. With this construction, when the canopy is released, the canopy trim 16 automatically pops off of the windshield top trim to facilitate retraction of the convertible boat top to the stowed position. This feature also enables the occupants to open the center panel of the windshield without requiring removal of the top.

With continued reference to FIGS. 2 and 7, the canopy 14 also includes a relief zipper 46 generally adjacent the interim bracket 32 and bracket 36. In the retracted position, as shown in FIG. 7, without the relief zipper 46, the canopy 14 would tend to be intrusive into the occupant space. In the stowed position, the relief zipper 46 can be opened so that the canopy 14 can be stowed further toward the rear of the boat.

Figure 4:
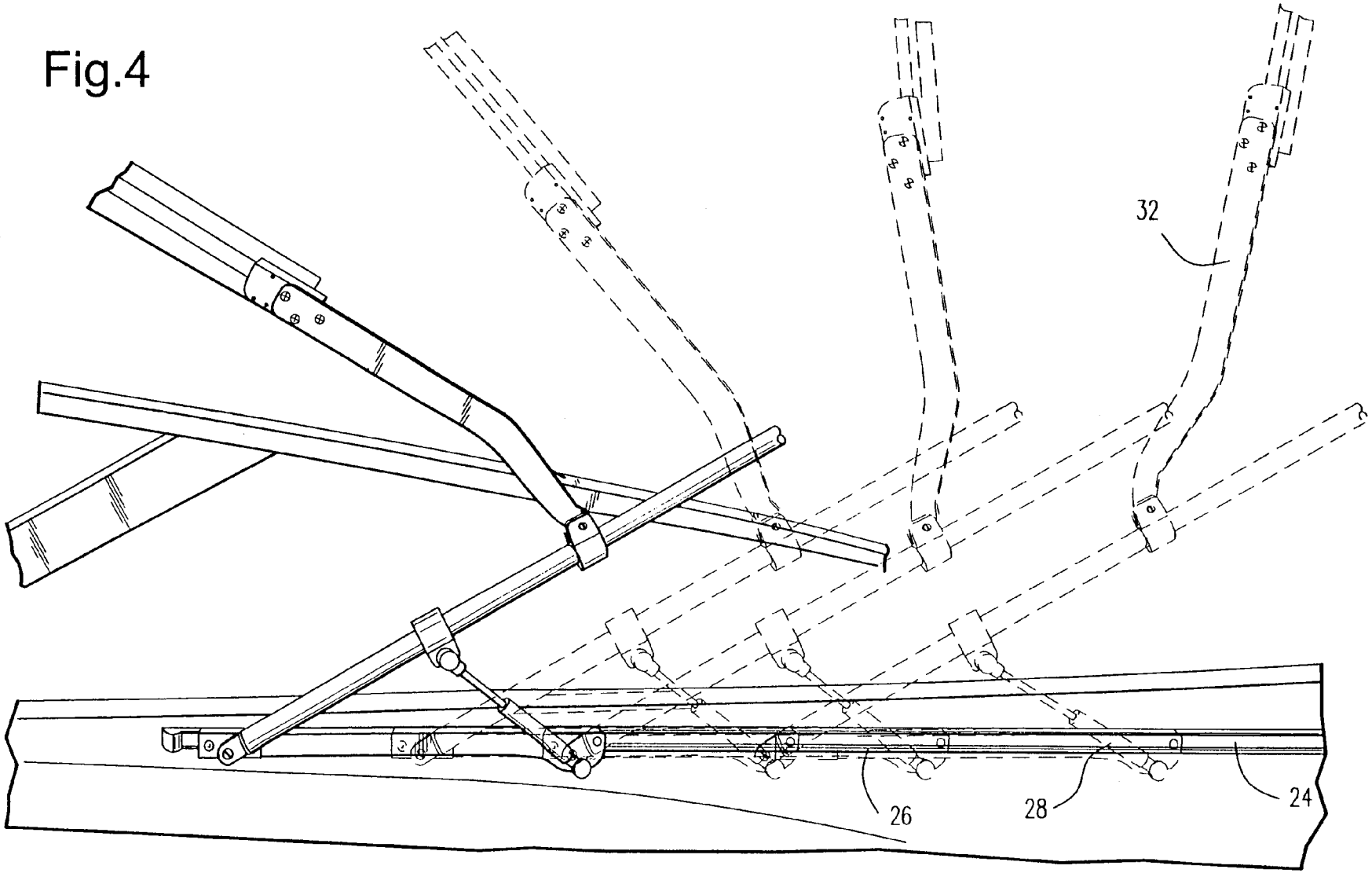
FIG. 4 is a sequence diagram showing stage positions of the link mechanism.

FIG. 4 is a sequence drawing showing multiple positions of the support structure 12 and slide mechanism 22 as the canopy 14 is shifted between its stowed position and its installed position. In operation, from the stowed position, the boat top structure is removed from storage and can be easily lifted with the assistance of the gas strut 28 to the leftmost position shown in FIG. 4. The canopy 14 can then be manually opened or pivoted forward as shown particularly by the pivoting of interim bracket 32 in FIG. 4. Simultaneously or in a separate step, the slide bracket 26 is slid forward on the slide rail 24 toward the leftmost position shown in FIG. 4. In this position, the canopy is brought forward to engage with the top trim 18 of the windshield frame.

Figure 5:
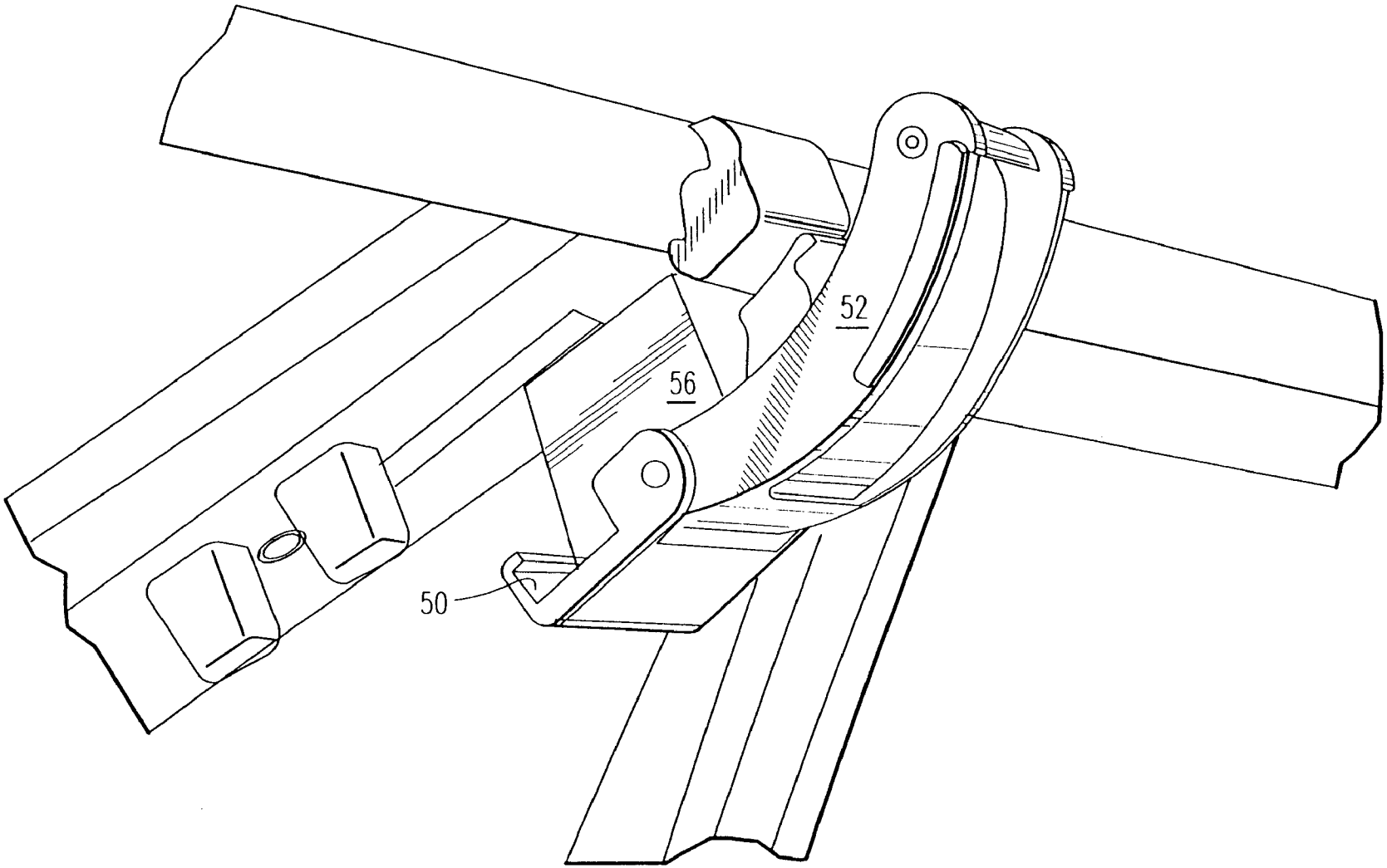
FIG. 5 is a perspective view showing one attachment of the convertible boat top to an existing portion of the windshield top trim.
Figure 6:
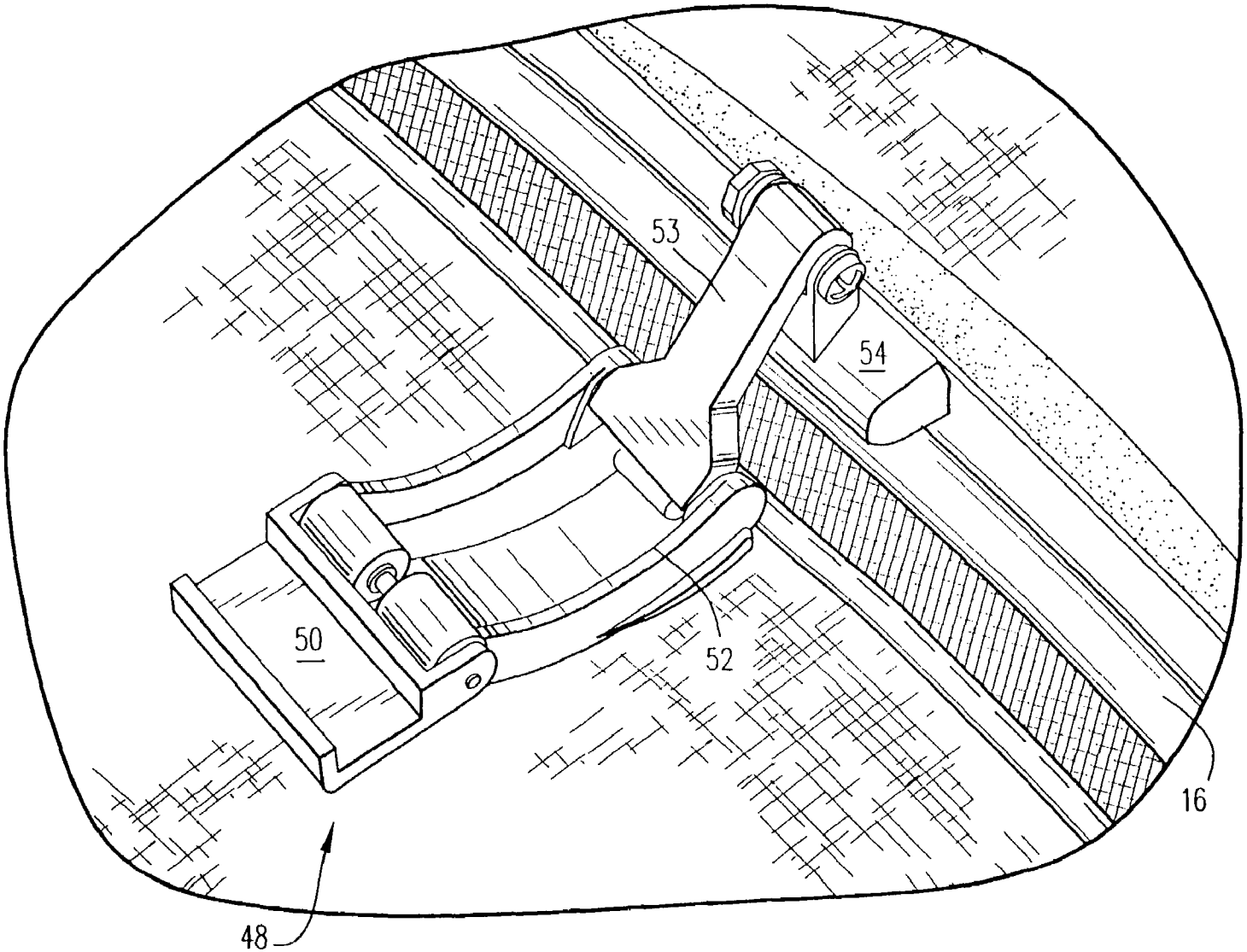
FIG. 6 shows the connector attached to the convertible boat top.

With reference to FIGS. 5 and 6, an attachment clip 48 is secured to the canopy 14 via the canopy trim 16. The attachment clip 48 includes a hook 50 that is pivotally attached to a hook lever 52, which in turn may be pivotally attached to a supporting bracket 54 via a latching bracket 53. At least one attachment clip 48 is mounted to the canopy trim 16 for securing the canvas 14 to the top trim 18 of the boat windshield, although in a preferred embodiment, two spaced attachment clips 48 are used. Obviously, the size of the boat may dictate the number of clips necessary to adequately secure the canopy to the top trim 18 of the windshield frame.

An attachment post 56 is appropriately mounted to the windshield frame for each attachment clip 48 on the canopy. With reference to FIG. 5, when the canopy is opened to its extended position, as noted above, the canopy trim 16 does not sit flush against the top trim 18 of the boat windshield. Using the lever 52, the user manually positions the hook 50 over the attachment post 56 then pivots the lever 52 upward via the latching bracket 53 to secure the canopy. This latching operation is repeated for each of the attachment clips 48 on the canopy 14. Of course, alternative latching structures may be suitable for securing the canopy trim 16 to the windshield frame top trim 18.

With this construction, a convertible boat top can be provided for a boat that is easily opened and closed and can be readily stowed to an unobtrusive storage position. Additionally, the convertible boat top can be provided as a kit to adapt an existing boat.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A convertible boat top comprising:

a canopy; and a support structure supporting the canopy and shiftable with the canopy between a stowed position and an installed position, wherein the support structure comprises, a main support bar engaging the canopy and coupled with a sliding mechanism, the main support bar being disposed in a first position in the sliding mechanism when the support structure is in the stowed position and in a second position in the sliding mechanism when the support structure is in the installed position, a pair of interim brackets respectively pivotally attached at one end to the main support bar and attached at an opposite end to the canopy, and a secondary support bar pivotally secured to the main support bar and including a crossbar extending across a width of the main support bar, the secondary support bar supporting a middle portion of the canopy.

2. A convertible boat top according to claim 1, wherein the interim brackets are attached to the canopy via respective canopy brackets.

3. A convertible boat top according to claim 1, wherein the canopy comprises a first sleeve through which the main support bar is threaded and a second sleeve through which the secondary support bar is threaded.

4. A convertible boat top according to claim 3, wherein the first sleeve is disposed at a rearward end of the canopy, and wherein the second sleeve is disposed at the middle portion of the canopy.

5. A convertible boat top according to claim 1, wherein the canopy comprises a canopy trim defining a shaped rigid forward perimeter of the canopy.

6. A convertible boat top according to claim 5, wherein the canopy trim comprises a rigid or semi-rigid rod threaded into a pocket formed in the forward perimeter of the canopy.

7. A convertible boat top according to claim 5, wherein the canopy trim is bowed such that the canopy does not sit flush with a top trim of a boat windshield frame.

8. A convertible boat top according to claim 5, further comprising an attachment clip secured to the canopy via the canopy trim, wherein the attachment clip is selectively securable to a top trim of a boat windshield frame.

9. A convertible boat top according to claim 8, comprising at least two attachment clips spaced along the canopy trim.

10. A convertible boat top according to claim 5, further comprising means for removably securing the boat top to a top trim of a boat windshield frame.

11. A convertible boat top according to claim 1, wherein the canopy comprises a first sleeve through which the main support bar is threaded.

12. A convertible boat top comprising:

a canopy; and a support structure supporting the canopy and shiftable with the canopy between a stowed position and an installed position, wherein the support structure comprises a main support bar engaging the canopy and coupled with a sliding mechanism, the main support bar being disposed in a first position in the sliding mechanism when the support structure is in the stowed position and in a second position in the sliding mechanism when the support structure is in the installed position, wherein the canopy comprises a canopy trim defining a shaped rigid forward perimeter of the canopy, and wherein the support structure further comprises a pair of interim brackets respectively pivotally attached at one end to the main support bar and attached at respective opposite ends to ends of the canopy trim.

13. A convertible boat top according to claim 12, wherein the interim brackets and the canopy trim are pivotable to a position adjacent the main support bar in the stowed position.

14. A convertible boat top according to claim 12, further comprising a secondary support bar pivotally secured to the main support bar and including a crossbar extending across a width of the main support bar, the secondary support bar supporting a middle portion of the canopy, wherein the interim brackets, the canopy trim and the secondary support bar are pivotable to a position adjacent the main support bar in the stowed position.

15. A convertible boat top comprising:

a canopy; and a support structure supporting the canopy and shiftable with the canopy between a stowed position and an installed position, wherein the support structure comprises a main support bar engaging the canopy and coupled with a sliding mechanism, the main support bar being disposed in a first position in the sliding mechanism when the support structure is in the stowed position and in a second position in the sliding mechanism when the support structure is in the installed position, wherein the sliding mechanism comprises a slide rail attachable to an interior boat surface and a sliding bracket mounted in sliding engagement with the slide rail, wherein the main support bar is pivotably secured to a first end of the sliding bracket, wherein the sliding mechanism further comprises a pivot device pivotably secured between a second end of the sliding bracket and the main support bar, and wherein the pivot device is configured to bias the main support bar toward the installed position.

16. A boat windshield assembly comprising:

a bottom trim member securable to a boat frame;

a windshield supported by the bottom trim member;

a top trim member affixed to the windshield; and a convertible boat top comprising, a canopy; and a support structure supporting the canopy and linearly shiftable with the canopy between a stowed position and an installed position, wherein the support structure comprises a main support bar engaging the canopy and coupled with a sliding mechanism, the main support bar being disposed in a first position in the sliding mechanism when the support structure is in the stowed position and is slideably displaced in a straight line to a second position in the sliding mechanism when the support structure is in the installed position, wherein the canopy comprises a canopy trim defining a shaped rigid forward perimeter of the canopy, the canopy trim being selectively attachable to the top trim member in the installed position, and wherein the support structure further comprises a pair of interim brackets respectively pivotally attached at one end to the main support bar and attached at respective opposite ends to front end of the canopy.

17. A boat comprising:

a boat frame including a passenger area and a motive power support area;

a bottom trim member secured to the boat frame;

a windshield supported by the bottom trim member;

a top trim member affixed to the windshield; and the convertible boat top as claimed in claim 1, the convertible boat top being selectively attachable to the top trim member in the installed position.

* * * * *